US005739645A

United States Patent [19]

Xia et al.

[11] Patent Number: 5,739,645

[45] Date of Patent: Apr. 14, 1998

[54] ELECTRONIC BALLAST WITH LAMP FLASH PROTECTION CIRCUIT

[75] Inventors: Yongping Xia; Xing-Xing Lu, both of Torrance; John Chou, Monterey Park, all of Calif.

[73] Assignee: Philips Electronics North America Corporation, New York, N.Y.

[21] Appl. No.: 645,546

[22] Filed: May 10, 1996

[51] Int. Cl.[6] ..... G05F 1/00

[52] U.S. Cl. ..... 315/307; 315/308; 315/224; 315/219; 315/244; 315/209 R

[58] Field of Search ..... 315/307, 224, 315/244, 219, 276, 290, 291, 306, 308, 209 R, DIG. 5, DIG. 7

[56] References Cited

U.S. PATENT DOCUMENTS 4,350,935 9/1982 Spira et al. ..... 315/291

5,111,118 5/1992 Fellows et al. ..... 315/307

5,359,274 10/1994 Brandel ..... 315/291 X 5,559,395 9/1996 Venkitasubrahmanian et al. ... 315/247

5,569,984 10/1996 Holtslag ..... 315/307

*Primary Examiner*—Robert Pascal

*Assistant Examiner*—Haissa Philogene

*Attorney, Agent, or Firm*—Arthur G. Schaier

[57] ABSTRACT

A programmed electronic ballast circuit including a voltage maintenance circuit to ensure that the integrated circuit continues to oscillate and drive the half-bridge inverter until the DC bus voltage falls to a level insufficient to permit the fluorescent bulbs at the output to ignite. Additionally, the voltage maintenance circuit drives the voltage of the integrated circuit down to a level whereby proper resetting of the integrated circuit and proper preheating of the florescent bulb filaments is assured.

10 Claims, 4 Drawing Sheets

ELECTRONIC BALLAST WITH LAMP FLASH PROTECTION CIRCUIT

BACKGROUND OF THE INVENTION

1. Field of the Invention

The present invention relates to electronic ballast circuits, and in particular, to an electronic ballast circuit that prevents undesirable light flashes, increases bulb life and ensures reliable lamp ignition.

2. Description of the Related Art

Electronic ballasts are known in the art. One example of a known electronic ballast circuit is described in U.S. Pat. No. 5,111,118. While this reference describes a fluorescent lamp controller that is deemed to operate fluorescent lamps or other loads efficiently and further, is deemed to provide reliable starting and efficient lamp operation, this reference does not describe or solve the problem, for example, of undesirable light flashes which may occur after the main power has been disconnected (i.e., a user shuts off the light via a light switch on a wall) from the electronic ballast circuit. Accordingly, an improved electronic ballast circuit that prevents undesirable light flashes, increases bulb life and ensures reliable lamp ignition is desired.

SUMMARY OF THE INVENTION

Generally speaking, one feature of a programmed start electronic ballast is to provide a proper preheating voltage on the filaments of a fluorescent lamp before a high voltage is applied to the lamps. The desired preheating time, which is typically a function of the circuit design, is usually about one (1) second. This preheating ensures that the filaments of the fluorescent lamp reach the desired temperature before the higher voltage is applied to the lamp for ignition. In the preferred embodiment of the present invention, a SGS-THOMSON's L6568E 16 pin integrated circuit is used to drive a half-bridge inverter circuit, although it would be well understood to one of ordinary skill in the art that an integrated circuit or discrete components that have similar functions to the integrated circuit described herein could be used while remaining within the scope of the invention.

In order to ensure a proper preheating procedure in the preferred embodiment of the invention, the integrated circuit requires that the supply voltage be below five volts before a new start up cycle is actuated. In a typical electronic ballast design configuration, however, the DC bus voltage can remain relatively high after the main power has been removed from the ballast circuit due to the large capacitor (C5) necessary to maintain a reasonable regulation ripple on the DC bus line. In the preferred embodiment, the voltage across capacitor (C5) charges the voltage supply capacitor of the integrated circuit. Therefore, after the main power to the electronic ballast circuit has been removed, the supply voltage to the integrated circuit will fall below the minimum threshold to continue oscillation and the integrated circuit will stop oscillating. However, since the electronic ballast circuit consumes very little current once oscillation of the integrated circuit stops and the florescent lamp is off, the large DC bus capacitor (C5) will once again charge the supply capacitor of the integrated circuit above the minimum threshold to begin oscillation thereof. If the integrated circuit begins to oscillate before the voltage across the DC bus capacitor (C5) discharges below the minimum threshold for the lamp to turn on, the lights will once again undesirably turn on and will remain on until the voltage across the DC bus capacitor can no longer sustain the ignition of the lamp.

Therefore, it is necessary to maintain the supply voltage of the integrated circuit above the minimum voltage threshold to continue oscillation thereof until the voltage across the DC bus capacitor (C5) falls to a level such that the florescent lamp cannot ignite regardless of whether the integrated circuit is oscillating.

Accordingly, in accordance with the present invention, an electronic ballast may include an inverter circuit for powering a lamp, an energy storage device switchably coupled to a power line, a voltage source having a varying level of voltage including a threshold level based on the energy storage device, a controller responsive to the voltage source being at or above the threshold level for driving the inverter circuit, and a voltage maintenance circuit for maintaining the voltage source at least at the threshold for a preferred period of time following decoupling of the energy storage device from the power line.

Additionally, to ensure proper initial start-up so as permit the integrated circuit to properly reset after the main power has been removed from the electronic ballast circuit, the supply voltage of the integrated circuit must be below a minimum threshold before power is once again applied to the electronic ballast circuit.

Accordingly, in accordance with the present invention, the voltage maintenance circuit also causes the supply voltage to fall below two volts after the DC bus capacitor has sufficiently discharged so that the integrated circuit can be reset and the filaments can be properly preheated.

It is therefore an object of the present invention to provide an improved electronic ballast circuit.

It is another object of the present invention to provide an electronic ballast circuit that avoids the problem of having the fluorescent lamps mm on after the main power has been removed from the ballast circuit.

Yet another object of the present invention is to provide an electronic ballast circuit that increases the life of the fluorescent lamp used therewith.

Still another object of the present invention is to provide an electronic ballast circuit that increases the reliability of ignition of the fluorescent lamp used therewith.

Another object of the present invention is to provide an electronic ballast circuit that is protected in the event the florescent lamp is damaged or removed from the circuit.

Still another object of the present invention is to provide an electronic ballast circuit that provides for reliable preheating of the filaments of the fluorescent lamp used therewith.

Yet another object of the present invention is to provide an electronic ballast circuit that ensures that the controller circuit is properly reset between uses.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

1. Description of the Electronic Ballast Circuit

Figure 1:
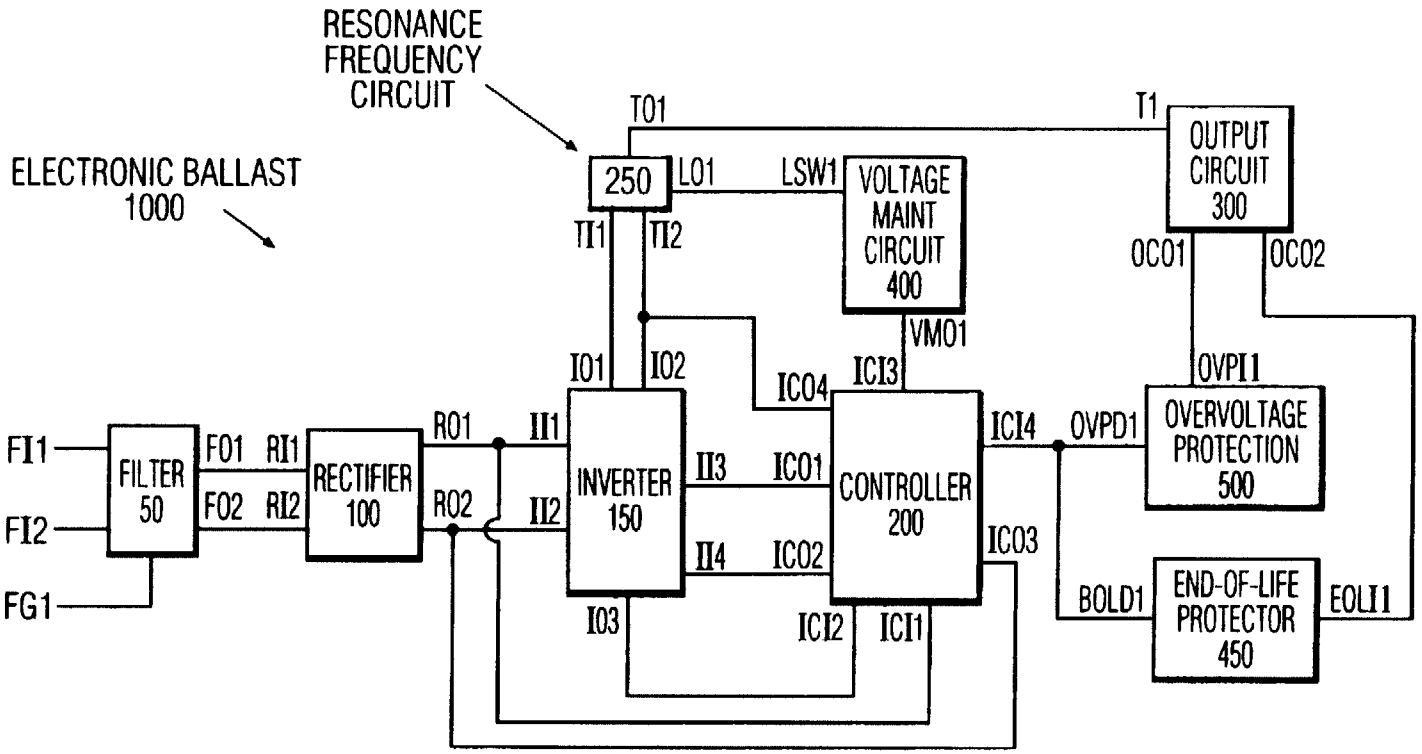
FIG. 1 is a block diagram of the electronic ballast constructed in accordance with the present invention.

Reference is first made to FIG. 1 wherein a block diagram of an electronic ballast circuit, generally indicated at 1000, constructed in accordance with the present invention, is depicted. Electronic ballast circuit 1000 (hereinafter "electronic ballast 1000") includes a filter 50 having two input terminals FI1 and FI2 for receiving an ordinary alternating current power line voltage, for example, of 120 volts. Filter 50 includes a ground input FG1 and two outputs FO1 and FO2. Output terminals FO1 and FO2 are respectively connected to terminal inputs RI1 and RI2 of a fullwave bridge rectifier 100 (hereinafter "rectifier 100"). For example, for a 120 V RMS, 60 Hz AC input at input terminals RI1 and RI2, rectifier 100 outputs a 170 V peak voltage. Rectifier 100 also includes two output terminals RO1 and RO2, their connections to be discussed below.

A half bridge inverter circuit 150 (hereinafter "inverter 150") is provided. Inverter 150 includes four input terminals II1, II2, II3 and II4 and three output terminals IO1, IO2 and IO3. Input terminals II1 and II2 are respectively connected to rectifier output terminals RO1 and RO2.

A controller 200 is provided. Controller 200 controls the operation of the half-bridge inverter 150. The heart of controller 200 is a 16-pin integrated circuit which will be described in detail below. Generally, controller 200 includes four output terminals ICO1, ICO2, ICO3, and ICO4. Controller 200 also includes four input terminals ICI1, ICI2, ICI3, and ICI4. Output terminals ICO1 and ICO2 of controller 200 are respectively connected to input terminals II3 and I14 of inverter 150. Input terminal ICI1 of controller 200 is connected to output terminal RO1 of rectifier 100. Input terminal ICI2 is connected to output terminal IO3 of inverter 150. Output terminal ICO3 is connected to output terminal RO2 of rectifier 100. Input terminal ICO4 is connected to output terminal IO2 of inverter 150.

A resonance frequency circuit 250 is provided. Resonance frequency circuit 250, which in the preferred embodiment, includes two capacitors and an inductor L3, also includes two input terminals TI1 and TI2 and two outputs LO1 and TO1. Input terminals TI1 and TI2 are respectively connected to output terminals IO1 and IO2 of inverter 150. Resonance frequency circuit 250 provides the voltage to power the voltage maintenance circuit which will be described in detail hereafter. Moreover, resonance frequency circuit is constructed so that at the desired resonance frequency, the lamps will ignite as discussed below.

An output circuit 300 is provided. In the preferred embodiment, output circuit 300 includes a transformer having a primary winding and five secondary windings, two fluorescent lamps, L1 and L2, and other components to be discussed below. Output circuit 300 includes one input T1 which is connected to output TO1 of resonance frequency circuit 250. Output circuit 300 also includes two outputs, OCO1 and OCO2.

A voltage maintenance circuit 400 constructed in accordance with the present invention provides the supply voltage to the controller for a period of time after the main power has been disconnected from input terminals FI1 and FI2 to ensure that the supply voltage of controller 200 remains sufficient to operate the controller, drive the half-bridge inverter and keep the fluorescent lamps on until the main DC bus capacitor, as discussed below, sufficiently discharges so that the fluorescent lamps cannot reignite. Additionally, after the DC bus voltage is below the threshold to allow, without application of line power, the florescent lamps to turn back on, voltage maintenance circuit 400 ensures that the supply voltage for the integrated circuit in the controller falls below 2 volts so that when the main power is reapplied to filter input terminals FI1 and FI2, the controller and associated components are reset and filaments of the fluorescent lamps can be adequately preheated. Voltage maintenance circuit 400 includes an input LSW1 and one output VMO1. Output VMO1 is connected to input terminal ICI3 of controller 200.

A Lamp End-of-Life protection circuit 450 (hereinafter "EOL protector 450") is provided. EOL protector 450 includes an input EOLI1 which is connected to output terminal OCO2 of output circuit 300. As discussed in greater detail below, EOL protection circuit detects the voltage across a capacitor (C11) within output circuit 300 to detect whether excessive current is passing through lamps L1 and L2.

An overvoltage protection circuit 500 is also provided. Overvoltage protection circuit 500 includes one input OVPI1 which is a connected to output OCO1 of output circuit 300. In the event that either or both of lamps L1 or L2 is removed from output circuit 300, there will be a low load on ballast transformer T1 resulting in a high voltage appearing across the output of overvoltage protection circuit 500. In the event that this condition is sensed by overvoltage protection circuit 500, overvoltage protection circuit 500 outputs a voltage by way of an output OVO1 to input ICI4 of controller 200. In this event, controller 200, enters the stand-by state, will stop oscillating, as farther discussed below.

Figure 2:
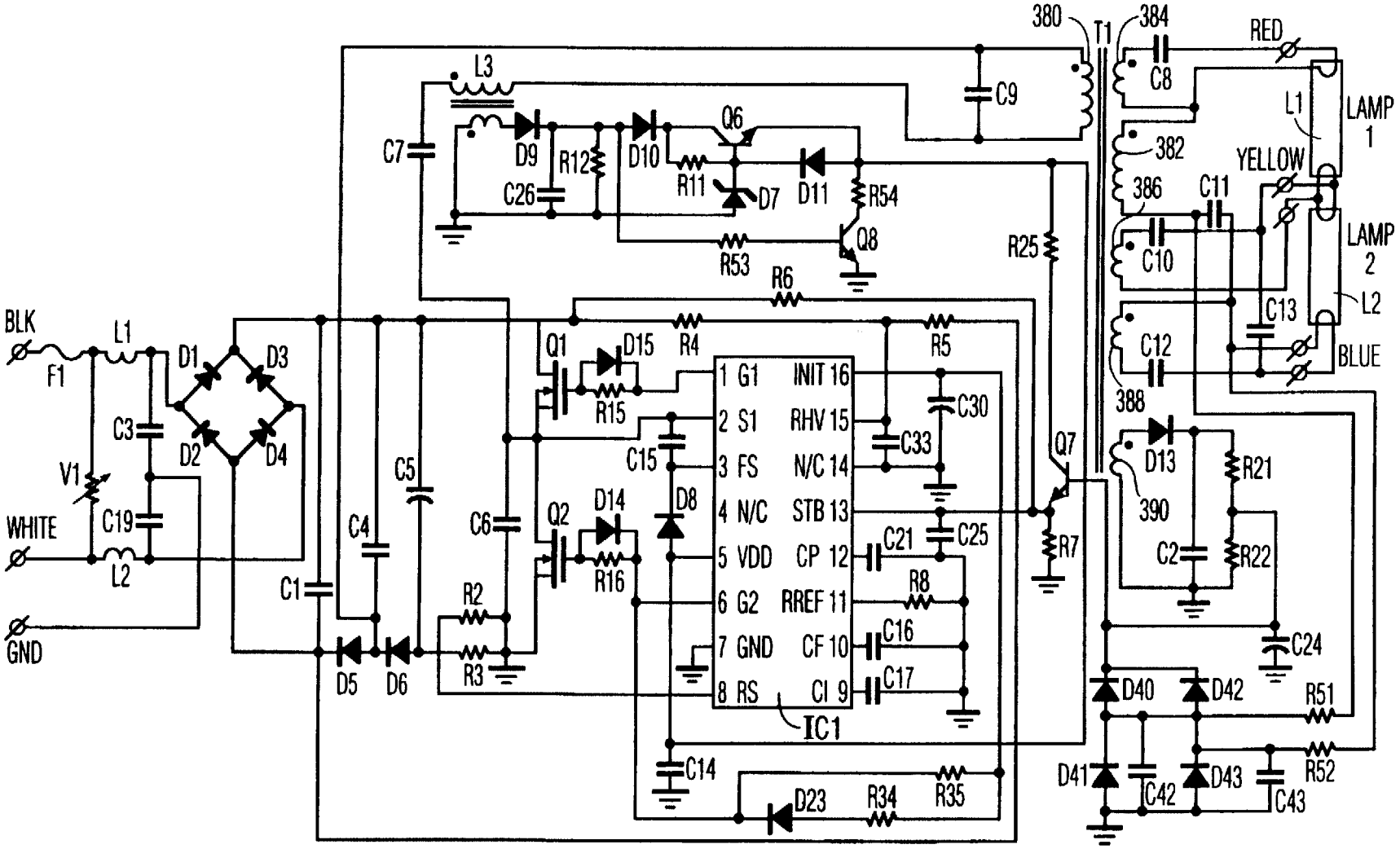
FIG. 2 shows a detailed schematic of the electronic ballast constructed in accordance with the present invention.

Reference will now be made to FIG. 2 which describes in further detail, the preferred embodiment of the present invention. Reference is first made to filter 50. As disclosed above, filter 50 includes input terminals FI1 and FI2 for receiving the power line voltage. A fuse F1, having one end thereof connected to input terminal FI1 is provided for over-current protection. First and second choke coils L1 and L2 are provided as depicted in FIG. 2. One end of coil L2 is connected to input terminal FI2. The second ends of coils L1 and L2 are respectively connected to output terminals FO1 and FO2. A transient surge suppressing metal oxide varistor V1 is connected between coil L1 and fuse F1, and the first end of coil L2. Varistor V1 conducts little at line voltage but conducts readily at higher voltages to protect the ballast circuit from high transient surge voltages. Capacitors C3 and C19, each having their respective first ends connected to ground terminal FG1 of filter 50, have their respective second ends connected to output terminals FO1 and FO2 of filter 50. Capacitors C3 and C19 form a common mode filter which prevents very high frequency components from the ballast circuit from entering the power line.

Reference is now made to rectifier 100 in greater detail. Rectifier 100 includes four diodes D1–D4 arranged as follows: the anode of diode D1 and the cathode of diode D2 are together connected to input terminal RI1. The anode of diode D3 and the cathode of diode D4 are together connected to input terminal RI2. The cathodes of diode D1 and D3 are together connected to output terminal RO1. The anodes of diodes D2 and D4 are together connected to output terminal RO2. A capacitor C1 is connected between output terminals RO1 and RO2 of rectifier 100.

Reference is now made to half-bridge inverter 150 with greater particularity. Inverter 150 includes a pair of switches Q1 and Q2 which, in the preferred embodiment are MOSFETS, arranged in a half-bridge configuration. Switches Q1 and Q2 are controlled by the respective gate drivers in the integrated circuit of controller 200. A capacitor C4 is provided between input terminal H1 of inverter 150 and the anode of a diode D5. The cathode of diode D5 is connected to input terminal II2. A large electrolytic capacitor C5 is provided, one end of which is also connected to input terminal II1. In the preferred embodiment, capacitor C5 is 39 microfarads and is chosen to maintain a reasonable regulation ripple on the DC bus. A diode D6 is provided, its anode being connected to the second end of capacitor C5 and its cathode being connected to the anode of diode D5 and output IO3 of inverter 150. The configuration of these diodes are known in the art and to reduce distortion on the line. The parallel connected sensing resistors R2 and R3 are connected between the anode of diode D6 and the source of switch Q2. The current through these resistors are sensed by an integrated circuit within the controller circuit to be described hereinafter. The source of switch Q2 is also connected to ground. A capacitor C6 is provided between the source and drain of switch Q2. The drain of switch Q2 is connected to output IO2. The source of switch Q1 is connected to the drain of switch Q2. The anode of diode D5 and the cathode of diode D6 are connected to IO1 of inverter 150.

The gate of switch Q1 is connected to the parallel combination of a resistor R15 and a diode D15, the anode of diode D15 being connected to output II3. The cathode of diode D15 is connected to the second end of resistor R15. The gate of switch Q2 is connected to the parallel combination of a resistor R16 and a diode D14, the anode of diode D14 being connected to output II4. The cathode of diode D14 is connected to the second end of resistor R16. Diode D15 in parallel with resistor R15 and diode D14 in parallel with resister R16 provide for rapid evacuation of charges from the respective control gates of switches Q2 and Q3 which enhance switching speed.

Figure 3:
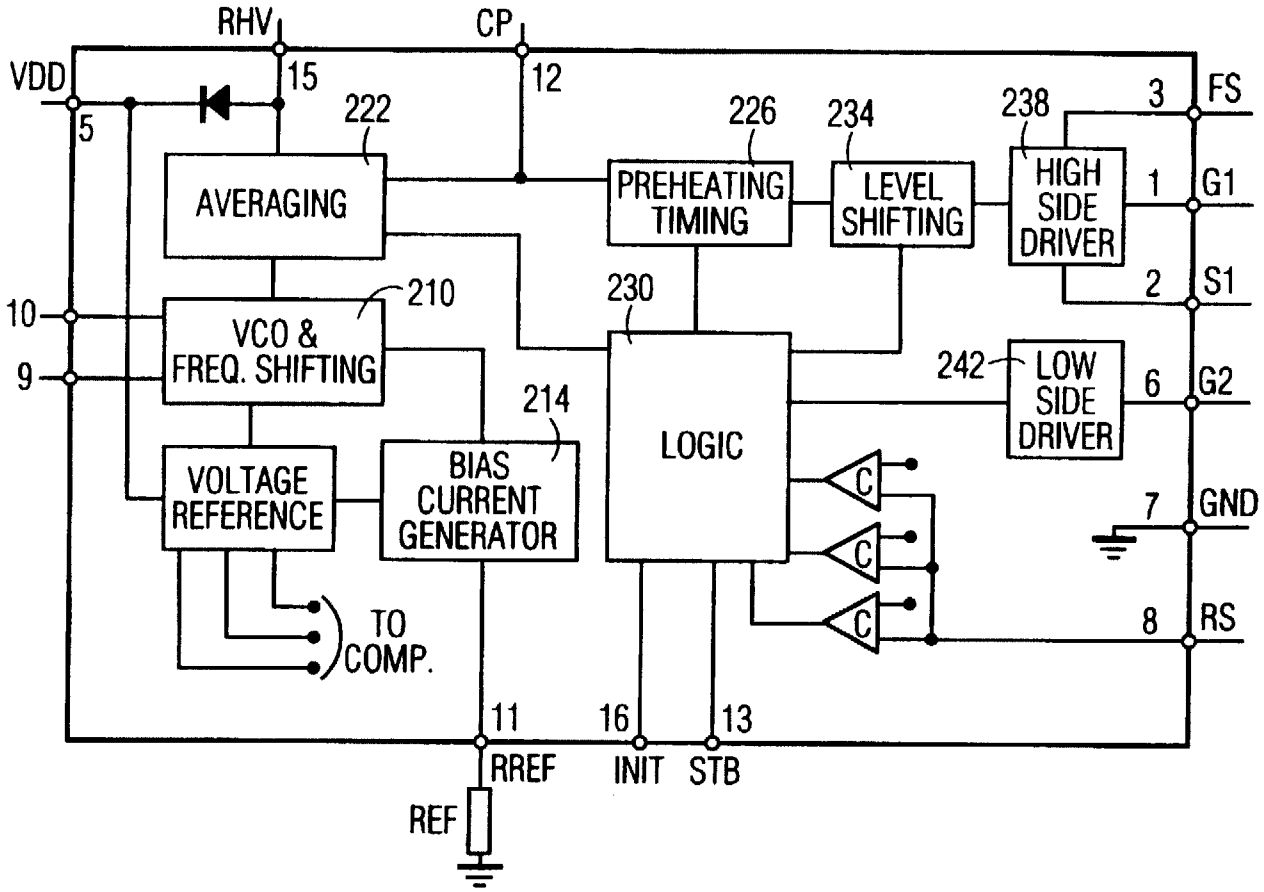
FIG. 3 is a block diagram of the preferred integrated circuit used in accordance with the preferred embodiment of the invention.

Reference is now made to controller 200 in greater detail. As stated above, controller circuit 200 controls the operation of inverter 150. The heart of controller 200 is a 16 pin integrated circuit IC1 (hereinafter "IC1"), which, in the preferred embodiment, is a SGS-Thomson's L6568E. A block diagram of the preferred integrated circuit is depicted in FIG. 3. However, it is to be understood that this preferred embodiment is by way of example and not by limitation, as it will be well understood by one of ordinary skill in the art that various other integrated circuits, having the characteristics described herein, can be used. The preferred integrated circuit includes a driver circuit for driving the half-bridge inverter 200 and controls the start-up, preheat, ignition and on-state operation of the electronically ballasted florescent lamps. The various control circuits of integrated circuit IC1, depicted in FIG. 3 and identified with reference numerals 210–242, will be referred to in the following description of pin connections and in the discussion of the half-bridge inverter operation.

As illustrated in FIGS. 1–3, pin 1 (G1) is connected to output terminal ICO1 and drives switch Q1. Pin 1 is also connected to the output of a high side driver 238 within IC1 so as to drive switch Q1. Pin 2 (S1), which is also connected to high side driver 238, is connected to output ICO4, the source of switch Q1 and the drain of switch Q2. Pin S1 is a floating source pin for high side driver 238 of IC1. Pin 3 (FS) is a floating supply that provides power for high side driver 238. A capacitor C15 is connected between pin 2 and pin 3. Pin 4 remains unconnected. Pin 5 (VDD) is the power supply input. A capacitor C14 is connected between pin 5 and ground. A diode D8 is connected between pins 3 and 5, with the anode thereof connected to pin 5. Pin 6 (G2) which is the output of a low side driver 242 within IC1, is connected to ICO2, thereby driving switch Q2. Pin 7 (GND) is connected to ground. Pin 8 (RS), the current monitoring input of IC1, is connected to input ICI2 and to the output IO3 of inverter 150 as well as to the logic circuit 230 of IC1. Pin 9 (CI) is connected to an internal oscillator 218 of IC1. An integrating capacitor C17 is connected between pin 9 and ground. As described below, capacitor C17 provides for the slow frequency shift. Pin 10 (CF) is also connected to oscillator 218 within IC1. A capacitor C16 is connected between pin 10 and ground. Capacitor C16 acts as an accurate external capacitor for frequency setting. Pin 11 (RREF) is connected to a bias current generator 214 within IC1. A resistor R8 is connected between pin 11 and ground. Pin 12 (CP) is connected to an averaging circuit 222 and the preheat timing circuit 226 within IC1. A capacitor C21 is connected between pin 12 and ground. External capacitor C21 is used to set the preheat timing during the preheating stage. At the end of the preheating stage, the voltage across capacitor C21 is zero. Secondly, capacitor C21 is used to set the stop timing duration when the open circuit lamp voltage exceeds the Vstor level during the ignition phase. The stop timing duration is equal to ½ of the preheat time. This function only becomes active at the instant the ignition sweeps starts. However, it remains active continuously thereafter. Pin 13 (STB) is connected to logic circuit 230 within IC1. A capacitor C25 is connected between pin 13 and ground. As will be discussed in greater detail below, a logic high signal on the STB pin will drive IC1 into the standby mode, for example, if there is a voltage surge indicating that a lamp has been damaged or removed from the output circuit. Pin 14 is connected to ground. Pin 15 (RHV) is connected to averaging circuit 222 within IC1. Also, an internal diode Dint within IC1 is connected between pin 15 and pin 5. The anode of diode Dint is connected to pin 15. A capacitor C33 is connected between pin 15 and ground. Lastly, pin 16 (INIT) is connected to internal logic circuit 230. A capacitor C30 is connected between pin 16 and ground. A resistor R35 is connected between pin 16 and pin 6. The series connection of a resistor R34 and a diode D23 is also connected between pins 16 and 6.

A resistor R6 is provided between input ICI1 and pin 13 (STB) of IC1. A resistor R4 is also provided between input ICI1 and pin 15 (RHV). In this way, an electrical path is provided between the DC bus voltage provided across capacitor C5 and capacitor C14 by way of resister R4 and internal diode Dint.

Lastly, controller 200 includes a transistor QT. A resistor R25 is connected between output terminal VMO1 of voltage maintenance circuit 400 and the collector of transistor Q7. A resistor R7 is connected between the emitter of Q7 and ground. The emitter of Q7 is also connected to pin 13 (STB) of ICI. The base of transistor Q7 is connected to input ICI4 of controller 200.

Reference is now made to resonance frequency circuit 250 in grater detail. As stated above, resonance frequency circuit 250 includes two input terminals TI1 and TI2. Input TI2 is connected to the first end of a capacitor C7, the second end of which is connected to the first end of the primary windings of an inductor L3. A capacitor C9 is connected between the second end of the primary windings of inductor L3 and input TI1. The resonance frequency of the circuit, determined by the preferred selection of L3 and capacitor C9, is selected in the preferred embodiment to be about 80 KHz, although other frequencies may be selected while remaining within the scope of the invention.

Reference is now made to output circuit 300 in greater detail. Output circuit 300 includes, by way of example, an iron core transformer T1 and two fluorescent lamps L1 and L2. Output circuit 300 includes a first pair of lamp terminals for connection to a first pair of lamp contacts between which extends a first (hereinafter "red") filament of LAMP L1. Output circuit 300 includes a second pair of lamp terminals which are respectively connected to a pair of lamp contacts on the second side of L1 and to a second pair of lamp contacts on L2 between which respective second and third (hereinafter "yellow") filaments extend. Lastly, output circuit 300 includes a third pair of lamp terminals for connection to a respective pair of lamp contacts on the second side of LAMP2 between which a fourth (hereinafter "blue") lamp filament extends.

Transformer T1 includes one primary winding 380 and five secondary windings 382, 384, 386, 388 and 390. The secondary windings 382 of transformer T1 has one end thereof connected to a lamp contact of the red filament as depicted in FIG. 2. A capacitor C11 is connected between one of the blue filaments of lamp L1 and the second end of secondary winding 382 as depicted in FIG. 2. As discussed below, secondary winding 382 provides a suitable voltage for igniting and operating lamps L1 and L2.

Secondary windings 384, 386 and 388 provide current through the red, yellow and blue filaments, respectively, for filament heating. Secondary winding 384 has one end thereof connected to a first end of a capacitor C8 while the second end of filament winding 384 is connected to a lamp contact of lamp L1 as shown in FIG. 2. The second end of capacitor C8 is connected to the second end of the red filament. Secondary winding 386 has one end thereof connected to a first end of a capacitor C10 while the other end of capacitor C10 is connected to one of the yellow filaments of both lamps L1 and L2 respectively, as shown in FIG. 2. The second end of filament winding 386 is connected to the other of the yellow filaments of lamps L1 and L2, respectively. Secondary winding 388 has one end thereof connected to one end of the blue filament of lamp L2 while the other end of secondary winding 388 is connected to a first end of a capacitor C12. The second end of capacitor C12 is connected to other end of the blue filament of lamp L2. Capacitors C8, C10, C12 serve to regulate changes in filament heating voltage and provide some impedance if the leads of the filament windings are shorted.

Reference will now be made to voltage maintenance circuit 400 in greater detail. Input LSW1 is connected between the secondary winding of inductor L3 and the anode of a diode D9. A capacitor C26 is connected between the cathode of diode D9 and ground. In the preferred embodiment, the rectified voltage across C26 is approximately 28 volts which is sufficient to maintain the voltage of IC1 high enough to maintain the voltage of the IC above the threshold where oscillation can continue until capacitor C5 has been sufficiently discharged. A resistor R12 is connected in parallel with capacitor C26. The anode of a diode D10 is also connected to the cathode of diode D9. A zener diode D7 has its anode connected to ground and its cathode connected to one end of a resistor R11. The second end of resistor R11 is connected to the cathode of diode D10. A pass transistor Q6 has its base connected to the cathode of zener diode D7. The collector of transistor Q6 is connected to the cathode of diode D9. A diode D11 is connected between the base and emitter of transistor Q6, with the anode thereof connected to the emitter of Q6. A transistor Q8 is provided. A resistor R53 is connected between the cathode of diode D9 and the base of transistor Q8. The emitter of transistor Q8 is connected to ground. A resistor R54 is connected between the collector of transistor Q8 and the emitter of transistor Q6.

Reference is now made to overvoltage protector circuit 500. As depicted in FIGS. 1 and 2, secondary winding 390 is connected to input OVPI1 and to the anode of a diode D13. The second end of secondary winding 390 is connected to ground. A capacitor C2 is connected between the cathode of diode D13 and ground. Two resistors, R21 and R22 are connected in series between the cathode of diode D13 and ground. The first end of a capacitor C24 is connected between resisters R21, R22. The second end of capacitor C24 is connected to ground. The first end of capacitor C24 is also connected to output terminal OVPO1 which itself is connected to the base of transistor Q7. As can be readily ascertained from one skilled in the art, if a lamp while the circuit is in normal operation, by way of example, there will be a voltage rise across secondary winding 390. This voltage is rectified by diode D13, filtered by capacitor C2, and divided by resistors R21 and R22. It is then sent to the base of transistor Q7. During normal operation, the voltage at the base of transistor Q7 is about 2.3 volts. Since pin 13 (STB) of IC1 needs at least 5 volts to go into the stand-by condition, 2.3 volts on the base of transistor Q7 will not be high enough to allow IC1 to go into the stand-by condition. Once one of the lamps are removed, the secondary winding 390 will generate a higher voltage such that the voltage on the base of transistor Q7 will exceed 5 volts. This condition will force IC1 to stop oscillation.

Reference is now made to EOL protector circuit 450 in greater detail. EOL protector circuit 450 includes two resistors R51 and R52, each of which have a first end respectively connected across C11. This connection is represented by input EOLI1. In addition, EOL protector circuit 450 includes, in the preferred embodiment, six additional components, diodes D40–D43 and capacitors C42 and C43, arranged as follows. The second end of resistor R51 is connected to the anode of diode D40 and the cathode of diode D41. The second end of resistor R51 is also connected to the first end of capacitor C42. The second end of resistor R52 is connected to the anode of diode D42 and the cathode of diode D43. The second end of resistor R52 is also connected to the first end of capacitor C43. The anodes of diodes D41 and D43 and the second ends of capacitors C42 and C43 are all connected to ground.

Once one or both lamps reach their end of life, there will be a measurable voltage across capacitor C11. This voltage will be detected at the base of Q7. Transistor Q7 will turn on thereby preventing IC1 from oscillating. In this way, the integrity of the circuit is further maintained.

2. Operation of the Electronic Ballast Circuit a. Initial Start-up

Figure 4:
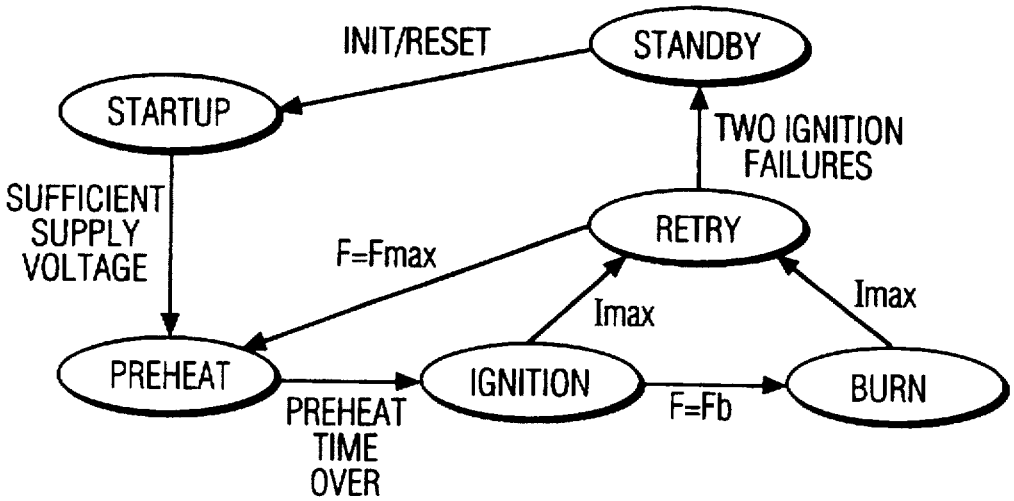
FIG. 4 is a flowchart illustrating the various stages of the electronic ballast circuit constructed in accordance with the present invention.

Reference is now made to FIG. 4 which depicts the various stages of electronic ballast circuit 1000. When the ballast is turned ON, i.e. the power line voltage is applied to input terminals FI1 and FI2. As discussed above, a 120 Hz, 170 V peak fully rectified DC voltage is present at rectifier output terminals RO1 and RO2.

Assuming two good lamps are present (i.e. both filaments in each lamp are intact), in the initial start-up phase, a 120 Hz AC signal is applied to input terminals FI1 and FI2, and VDD supply capacitor C14 will charge in the following manner. Current flows through resistor R4 and into pin 15 of IC1. As discussed above, and depicted in FIG. 3, internal diode Dint of IC1 provides the conduit from pin 15 to pin 5, thereby allowing a voltage to develop across capacitor C14.

In the start-up phase, IC1 will be reset. Additionally, throughout the initial charging of VDD supply capacitor C14, which occurs for a voltage at pin VDD in the range of 0 V to a voltage "VDon" of about 11.7 V, IC1 is considered to be in a "startup" phase. During the startup phase, the IC1 is in a non-oscillating condition and simultaneous conduction of switches Q1 and Q2 is prevented throughout this phase.

For the voltage at the VDD pin exceeding a level "VDlow" of about 6.5 volts, switch Q2 will be conductive and switch Q1 will be non conductive to ensure that the bootstrap capacitor C15 is charged to a voltage level near VDD at the end of the initial charging phase. At the end of this start-up phase, the voltage at pin 5 (VDD) is about 11.7 volts.

b. Oscillation

Once the supply capacitor C14 is charged to a value to Vdon (typically 11.7 volts), IC1 will start oscillating and the circuit can begin the preheating operation. The internal oscillator 218, via the logic circuit 230, a level shifter 234, and high side driver 238 and low side driver 242, alternately drives switches Q1 and Q2 into conduction with an identical forward conductance time. The duration of non-overlap between conductance of Q1 and Q2 (non-overlap time) is fixed at about 1.4 μs. The oscillator operates in the forward conductance mode of control and outputs a generally sawtooth waveform. The frequency of the sawtooth waveform is determined by both capacitor C16 connected to pin 10 (CF) and the current out of pin 10 which is set by resistor R8, connected to pin 11 (RREF).

c. Operation in the Preheat Stage

Figure 5:
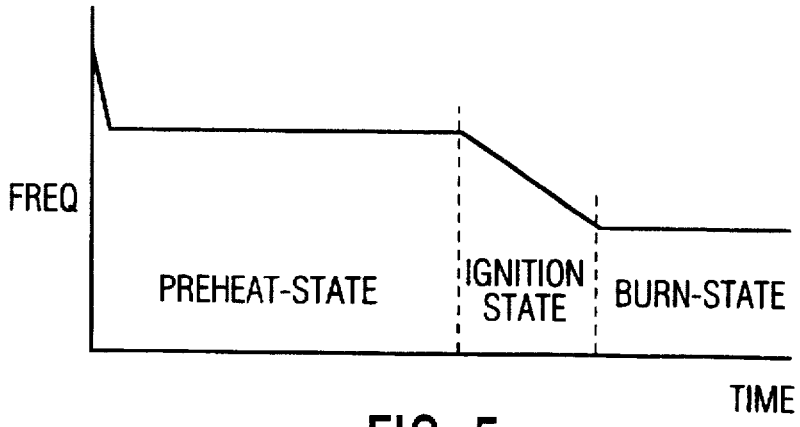
FIG. 5 is a graph illustrating the frequency excursion time of the integrated circuit constructed in accordance with the present invention.

Once the supply capacitor C14 is charged above VDon, switches Q1 and Q2 begin oscillating and the preheat stage can begin. IC1 begins oscillating at a frequency which is greater than 125 kHz. As depicted in FIG. 5, the oscillation frequency will gradually decrease until a predetermined current level is detected through resisters R2 and R3. The rate of the decrease in oscillation frequency is determined by capacitor C17 connected to pin 9 (CI) of IC1. In the preferred embodiment, the rate of decrease is typically between 0.005 %/cycle to 0.5%/cycle. During the preheating stage, the oscillation frequency is much greater than the resonance frequency. The load is essentially determined by inductor L3 and capacitor C9, which in the preferred embodiment is 0.185 μH and 0.022 μF, respectively. The duration of the preheat cycle is determined by capacitor C21 tied to the CP pin and resistor R8 tied to pin 11 (RREF) of IC1. In the preferred embodiment, the duration of the preheat stage is about one (1) second to assure that the filaments reach the desired temperature before applying a higher voltage to ignite the lamps.

c. Ignition State

After the preheat stage is over, the frequency will begin to decrease further, as illustrated in FIG. 5. The frequency will either reach a minimum oscillation frequency of about 43 KHz (which is the minimum oscillating frequency of IC1) or will reach a frequency set by the feedforward circuit. The feedforward frequency is controlled by capacitor C16 and the current (Irhv) injected into pin 15 (RHV). Since capacitor C16 is a constant value, the feedforward frequency is proportional to Irhv. There are two sources to provide current Irhv. One is the DC bus voltage through resistor R4. The lower the input AC voltage, the lower the DC bus voltage, and therefore, the lower the feedforward frequency. Since the impedance of inductor L3 will be lower at lower frequencies, the current passing through inductor L3 will be compensated to have less change due to the variation of input voltage. The second source of current Irhv is the rectified input voltage through resistor R5. This input is used to modulate the feedforward frequency such that the output applied on the lamps can meet the crest factor specification. In the preferred embodiment the feedforward frequency is centered at 60 KHz with +/−10 KHz modulation. As stated above, the rate of decrease in the oscillating frequency is determined by capacitor C17. During the downward frequency sweep, the voltage across the load is increasing and the oscillating frequency is approaching the resonance frequency of the load. Consequently, when the oscillation frequency is equal to the resonance frequency, a high voltage will appear across the lamps resulting in lamp ignition.

In the preferred embodiment, lamps L1 and L2 do not ignite simultaneously. Capacitor C13 is selected such that there is a greater voltage drop across L1 than L2 at the resonance frequency. Therefore, to one skilled in the art it is clear that at the resonance frequency, lamp L1 will ignite first. Thereafter, a higher voltage appearing across secondary winding 382 will appear across lamp L2. In this way, the firing of both lamps is assured. Additionally, pin 12 is disconnected from the timer circuit and will be connected to the internal resistor of the feedforward circuit.

d. Failure to ignite

Failure of the lamp to ignite will cause the current through sensing resistors R2 and R3 to increase. This increase in current is sensed by pin 8 (RS) of IC1. If the current exceeds Imax, which in the preferred embodiment is 2.6 amps, it is assumed that the lamp did not ignite. In this situation, the oscillation frequency will be gradually increased to the maximum frequency and the preheat cycle will begin again with the same preheat time as depicted in FIG. 4. In the case of a second ignition failure, the circuit will be shut down.

e. Normal operation

Assuming the lamp has ignited during the downwards frequency sweep, the frequency will decrease to the bottom frequency Fb determined by resistor R8 and capacitor C16 (typically 43 KHz in the preferred embodiment) or the frequency determined by the feedforward circuit.

f. Capacitive mode protection

IC1 protects the half-bridge inverter and output circuit from capacitive mode operation. This is achieved by measuring the load current at the end of conduction of switch Q2. This load current is measured by pin 8. If this detected current is below a predetermined value (at the time switch Q2 is off), capacitive mode is assumed and consequently, the frequency is immediately increased to turn off the load current. The capacitive mode detection is not operative during preheating.

g. Stand-by state

The stand-by state is characterized by switch Q2 being in the conductive state and Q1 being in the non-conductive state. The only way IC1 can exit the stand-by state is by means of a positive going slope of the voltage at pin 16 (INIT) or when the voltage at pin 5 falls below 10 volts and next exceeds 11.7 volts.

h. Main Power Shut-off

As stated above, once the voltage on pin 5 (VDD) reaches 11.7 volts, IC1 will begin oscillating and switches Q1 and Q2 will begin alternately switching. However, when the main power to the circuit is removed from filter input terminals FI1 and FI2 (for example, a user shuts off the lights), capacitor C5 is still charged. For the lamps L1 and L2 to operate, the voltage across capacitor C5 must be a minimum of 80 volts in the preferred embodiment. (During normal operation, capacitor C5 has about 180 volts DC thereacross.) Once the main power is shut-off, the voltage at pin 5 of IC1 immediately begins to decrease. The internal characteristics of IC1 are such that IC1 will stop oscillating when the voltage across pin 5 drops below about 11 volts. Once main power is removed from the circuit, the voltage across at pin 5 of IC1, being derived from the voltage across capacitor C5, also falls below 11 volts within one (1) millisecond of main power shut-down. Since IC1 consumes very little current when the IC stops oscillating, capacitor C14 typically begins to recharge (through resistor R4 and diode Dint) and the voltage at pin 5 of IC1 will once again rise to a threshold value such that oscillation of IC1 begins again. If the voltage across capacitor C14 charges to 11.7 volts where IC1 begins to oscillate before the voltage across capacitor C5 discharges below 80 volts, the lights will once again undesirably turn on. The lamps will remain on until the voltage across C5 can no longer sustain the ignition of the lamps.

Therefore, it is necessary to maintain the voltage at pin 5 above 11.7 volts (or at least above the minimum threshold of 11 volts) to ensure that IC1 continues to oscillate until the voltage across capacitor C5 falls below 80 volts. Once the voltage across capacitor C5 falls below 80 volts, the lamps cannot turn on regardless of the voltage at pin 5 of IC1. Since electronic ballast circuit 1000 consumes about 280 milliamps during normal operation (i.e. the lamps are on), once the main power is shut-off, it will take approximately 14 milliseconds [(180–80) volts×0.000039 Farads/0.28 amps] for the voltage across capacitor C5 to fall below 80 volts if the lamps are still on.

Therefore, it is necessary to maintain the voltage at pin 5 above 11 volts for at least 14 milliseconds after the main power has been mined off to ensure that capacitor C5 can discharge sufficiently to reduce the voltage thereacross to below 80 volts so the lights cannot turn on, regardless of whether the voltage at pin 5 of IC1 thereafter rises again above the threshold to begin oscillation.

Voltage maintenance circuit 400 maintain the voltage at pin 5 above the minimum 11 volts threshold for oscillation for greater than 14 milliseconds after main power shut-off. As stated above, it is desired to select the voltage across capacitor C26 sufficiently higher than 11 volts to ensure that a sufficient time will elapse before the voltage at pin 5 falls below 11 volts. It has been determined that charging capacitor C26 to 28 volts is an acceptable level, but it is understood that this is by way of example and not limitation. Furthermore, IC1 consumes about 20 milliamps during normal operation. Therefore, in order to maintain the voltage at pin 5 of IC1 greater than 11 volts, capacitor C26 should be chosen to be at least 16.5 microfarads (0.02 amps×14 milliseconds)/(28–11 volts). In this way, once main power is shut off, capacitor C14 is maintained at a voltage above 11 volts. IC1 will continue to oscillate for at least 14 milliseconds to ensure that capacitor C5 discharges below 80 volts so as to prevent the lamps from turning back on.

Additionally, to ensure proper initial start-up so as permit IC1 to properly reset after the main power has been removed from input terminal FI1 and FI2, the voltage across VDD must be below 5 volts before the IC is subsequently powered up. Experimental testing has determined that, once capacitor C14 is charged up to its normal operating voltage of 11.7 volts, it takes approximately ten (10) seconds for the voltage across capacitor C14 to fall below five (5) volts. If the voltage at pin 5 does not fall below five (5) volts before a subsequent power up, proper resetting of IC1 and preheating of the lamp filaments cannot be assured.

Voltage maintenance circuit 400 also sufficiently discharges capacitor C14 after main power turn-off to ensure that the voltage at pin 5 continues to fall below five (5) volts to ensure proper resetting of IC1 and proper preheating once the main power is reapplied to the circuit (i.e. a user rams the lights back on). In the preferred embodiment, as discussed below, C14 is discharged well below 5 volts to approximately 2 volts.

Specifically, once IC1 stops oscillating after main power shut-off, IC1 draws about 0.2 milliamps. The voltage across capacitor C26 in combination with resistor R53, will continue to drive transistor Q8 as long as the voltage across capacitor C26 is greater than one (1) volt. Since resistor R54 is selected to be 4.7 Kohms, the voltage at pin 5 will continue to fall below two (2) volts. With the voltage at pin 5 below two volts, the main voltage can be reapplied to the circuit and a proper start-up stage can be assured.

By providing an electronic ballast circuit in accordance with the present invention, problems associated with unwanted lamp ignitions are eliminated. Additionally, an electronic ballast circuit in accordance with the present invention significantly increases the useful life of fluorescent lamps used therewith due to the proper preheating of the filaments thereof. Moreover, the reliability of proper ignition of the fluorescent lamps used in an electronic ballast circuit in accordance with the present invention is increased. Still further, an electronic ballast circuit in accordance with the present invention electronic ballast is protected in the event that a florescent bulb is damaged or removed from the circuit. Lastly, an electronic ballast circuit in accordance with the present invention ensures that the integrated circuit incorporated therein is properly reset between uses.

While there has been shown to be what is presently considered to be the preferred embodiment of the invention, it will be apparent to those of ordinary skill in the art that various modifications can be made without departing from the scope of the invention as defined by the appended claims. In particular, the various values given for various voltage stop or start levels, capacitor values and impedances, for example, are selected for the illustrated implementation and may differ for different lamp applications. Accordingly, the disclosure is illustrative only and not limiting.

We claim:

1. An electronic ballast including an inverter circuit for powering a lamp, said electronic ballast comprising:

an energy storage device couplable to a power line;

a voltage source having a varying level of voltage including a threshold level based on the energy storage device;

a controller, responsive to the voltage source, for driving the inverter circuit when said voltage source is at or above said threshold level; and a voltage maintenance circuit for maintaining the voltage source, following decoupling of the energy storage device from said power line, at or above said threshold until said energy stored in said energy storage device is insufficient to permit an ignition of a lamp.

2. The electronic ballast as claimed in claim 1, wherein said energy storage device includes a capacitor, and said voltage maintenance circuit maintains the voltage source at or above said threshold level until at least the time necessary for said capacitor to discharge so that a lamp will not ignite when said inverter circuit is being driven by said controller.

3. The electronic ballast as claimed in claim 2, wherein said voltage maintenance circuit reduces the voltage level of said voltage source below said threshold level after said capacitor discharges sufficiently such that a lamp will not ignite when said inverter circuit is being driven by said controller.

4. The electronic ballast as claimed in claim 3, wherein said voltage maintenance circuit reduces the voltage level of said voltage source to below 2 volts.

5. The electronic ballast as claimed in claim 2, and including an output circuit for igniting a lamp, said output circuit including a transformer, and wherein the voltage level at which a lamp will not ignite if said inverter circuit is being driven by said controller is a function of said transformer windings.

6. The electronic ballast as claimed in claim 5, wherein said minimum threshold at which a lamp will not ignite inverter circuit is be driven by said controller is about 80 volts.

7. The electronic ballast as claimed in claim 1, wherein said voltage source includes a voltage source capacitor and said controller includes an integrated circuit, said voltage maintenance circuit for keeping said voltage source capacitor charged at least at said threshold level when said energy storage device is decoupled from said power line and has sufficient energy to ignite a lamp when said inverter circuit is being driven by said controller.

8. The electronic ballast as claimed in claim 7, wherein said voltage maintenance circuit includes a voltage maintenance capacitor charged to a voltage sufficient to charge said voltage source capacitor so that said voltage source capacitor is at or above said threshold level when said energy storage device is decoupled from said power line and has sufficient energy to ignite a lamp when said inverter circuit is being driven by said controller.

9. The electronic ballast as claimed in claim 8, wherein said voltage maintenance circuit reduces the voltage level of said voltage source capacitor below said threshold level after said energy storage device has discharged sufficiently such that a lamp will not ignite when said inverter circuit is being driven by said controller.

10. The electronic ballast as claimed in claim 9, wherein said voltage maintenance capacitor continues to discharge after said energy storage device has sufficiently discharged so that said voltage source capacitor discharges to about 2 volts.

* * * * *